US010925419B2

(12) United States Patent
Sherry

(10) Patent No.: US 10,925,419 B2
(45) Date of Patent: Feb. 23, 2021

(54) INFLATABLE BODY PILLOW AND PILLOW CASE KIT

(71) Applicant: Sharon Sherry, Independence, MO (US)

(72) Inventor: Sharon Sherry, Independence, MO (US)

( * ) Notice: Subject to any disclaimer, the term of this patent is extended or adjusted under 35 U.S.C. 154(b) by 183 days.

(21) Appl. No.: 16/184,275

(22) Filed: Nov. 8, 2018

(65) Prior Publication Data

US 2020/0146475 A1 May 14, 2020

(51) Int. Cl.

| | |
|---|---|
| ***A47G 9/10*** | (2006.01) |
| ***A47C 20/02*** | (2006.01) |
| ***A47G 9/04*** | (2006.01) |
| ***A45F 3/14*** | (2006.01) |
| ***A47G 9/02*** | (2006.01) |

(52) U.S. Cl.
CPC ..... *A47G 9/1027* (2013.01); *A45F 3/14* (2013.01); *A47C 20/02* (2013.01); *A47G 9/0253* (2013.01); *A47G 9/04* (2013.01); *A45F 2003/142* (2013.01)

(58) Field of Classification Search
CPC ..... A47G 9/08; A47G 9/10; A47G 9/1027
USPC ..... 5/413 R, 413 AM, 706
See application file for complete search history.

(56) References Cited

U.S. PATENT DOCUMENTS

| | | | | |
|---|---|---|---|---|
| 2,919,747 | A * | 1/1960 | Post | A47C 27/087 428/102 |
| 4,277,859 | A | 7/1981 | Seaman | |
| 4,604,765 | A * | 8/1986 | Schultz | A47G 9/086 224/153 |
| 7,322,057 | B2 | 1/2008 | Melini | |
| 9,101,234 | B2 | 8/2015 | Berg | |
| 9,526,361 | B2 | 12/2016 | Sellmeyer | |
| 9,801,480 | B1 | 10/2017 | McCain | |
| 2005/0060806 | A1 | 3/2005 | Wilkinson | |
| 2014/0041125 | A1 | 2/2014 | Grealy | |

FOREIGN PATENT DOCUMENTS

WO WO20120151610 11/2012

* cited by examiner

*Primary Examiner* — Fredrick C Conley

(57) ABSTRACT

An inflatable body pillow and pillow case kit for portability includes an inflatable body pillow and a pillow case. The inflatable body pillow comprises a principal chamber and a pair of side chambers coupled to the principal chamber. A plurality of vents is coupled to the principal chamber and allows air to flow between the principal chamber and the pair of side chambers. A valve is coupled to the principal chamber through the bottom end and is configured to allow a user to inflate and alternatively deflate the principal chamber and the pair of side chambers. The pillow case comprises a case body having an open bottom edge to receive the inflatable body pillow.

6 Claims, 6 Drawing Sheets

INFLATABLE BODY PILLOW AND PILLOW CASE KIT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to body pillows and more particularly pertains to a new body pillow for portability.

BRIEF SUMMARY OF THE INVENTION

An embodiment of the disclosure meets the needs presented above by generally comprising an inflatable body pillow and a pillow case. The inflatable body pillow comprises a principal chamber having a top end, a bottom end, an upper side, a lower side, a left wall, and a right wall. A pair of side chambers is coupled to the principal chamber. The pair of side chambers comprising a left chamber and a right chamber continuously coupled to the left wall and the right wall, respectively. A plurality of vents is coupled to the principal chamber and is disposed within each of the left wall and the right wall to allow air to flow between the principal chamber and the pair of side chambers. A valve is coupled to the principal chamber through the bottom end and is configured to allow a user to inflate and alternatively deflate the principal chamber and the pair of side chambers. The inflatable body pillow has an inflated state and an alternate deflated state. The pillow case comprises a case body having a top edge, a bottom edge, a left edge, a right edge, a top side, and a bottom side. The top side is coupled to the bottom side along the top edge, the left edge, and the right edge. The bottom edge is open and receives the inflatable body pillow.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
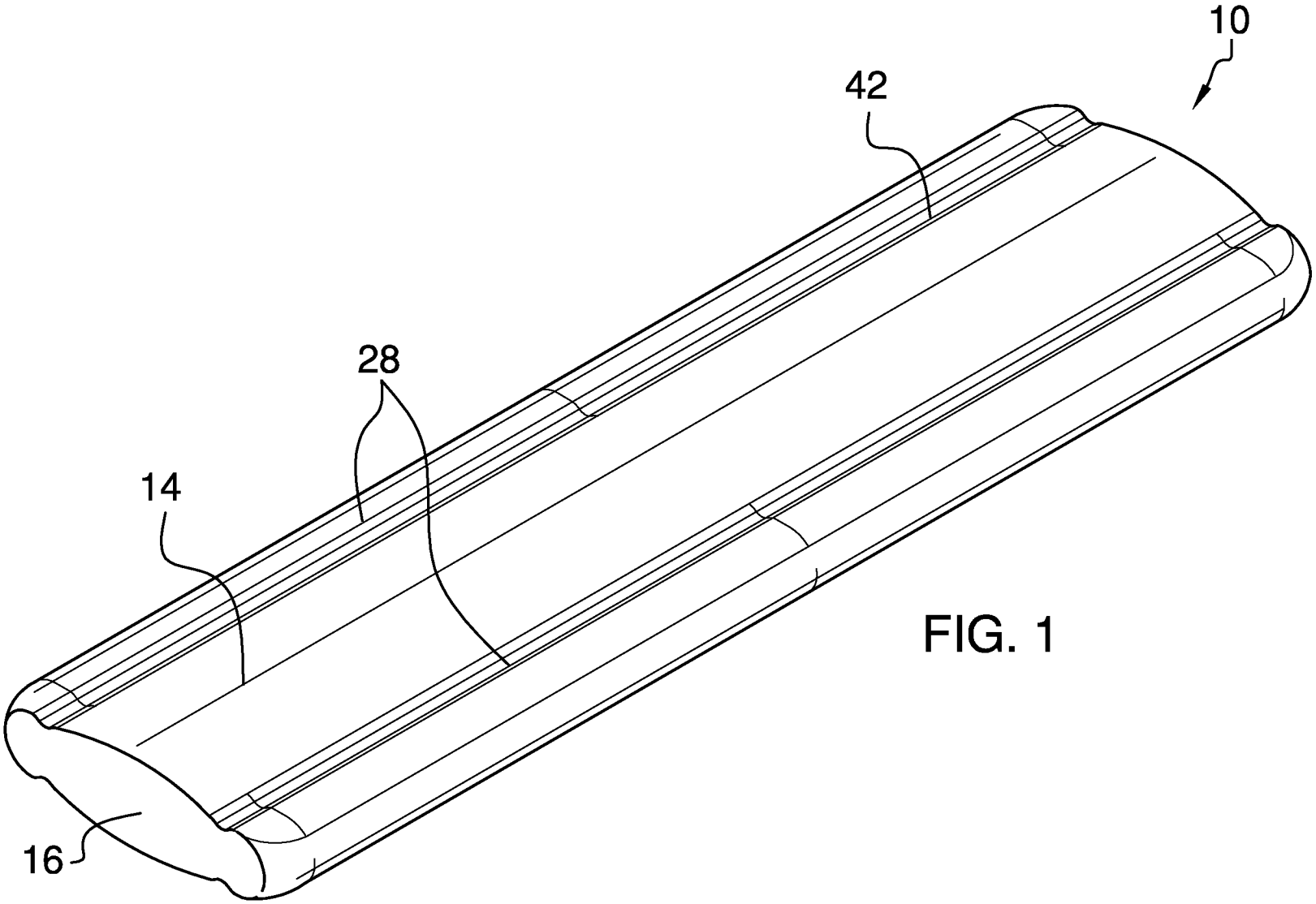
FIG. 1 is an isometric view of an inflatable body pillow and pillow case kit according to an embodiment of the disclosure.
Figure 2:
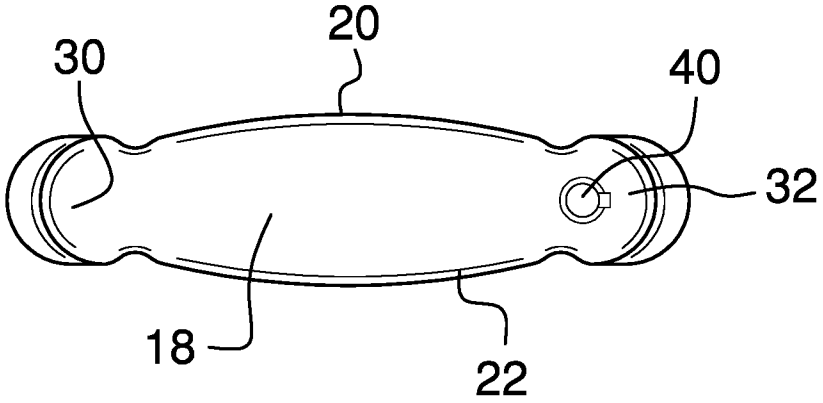
FIG. 2 is a rear elevation view of an embodiment of the disclosure.
Figure 3:
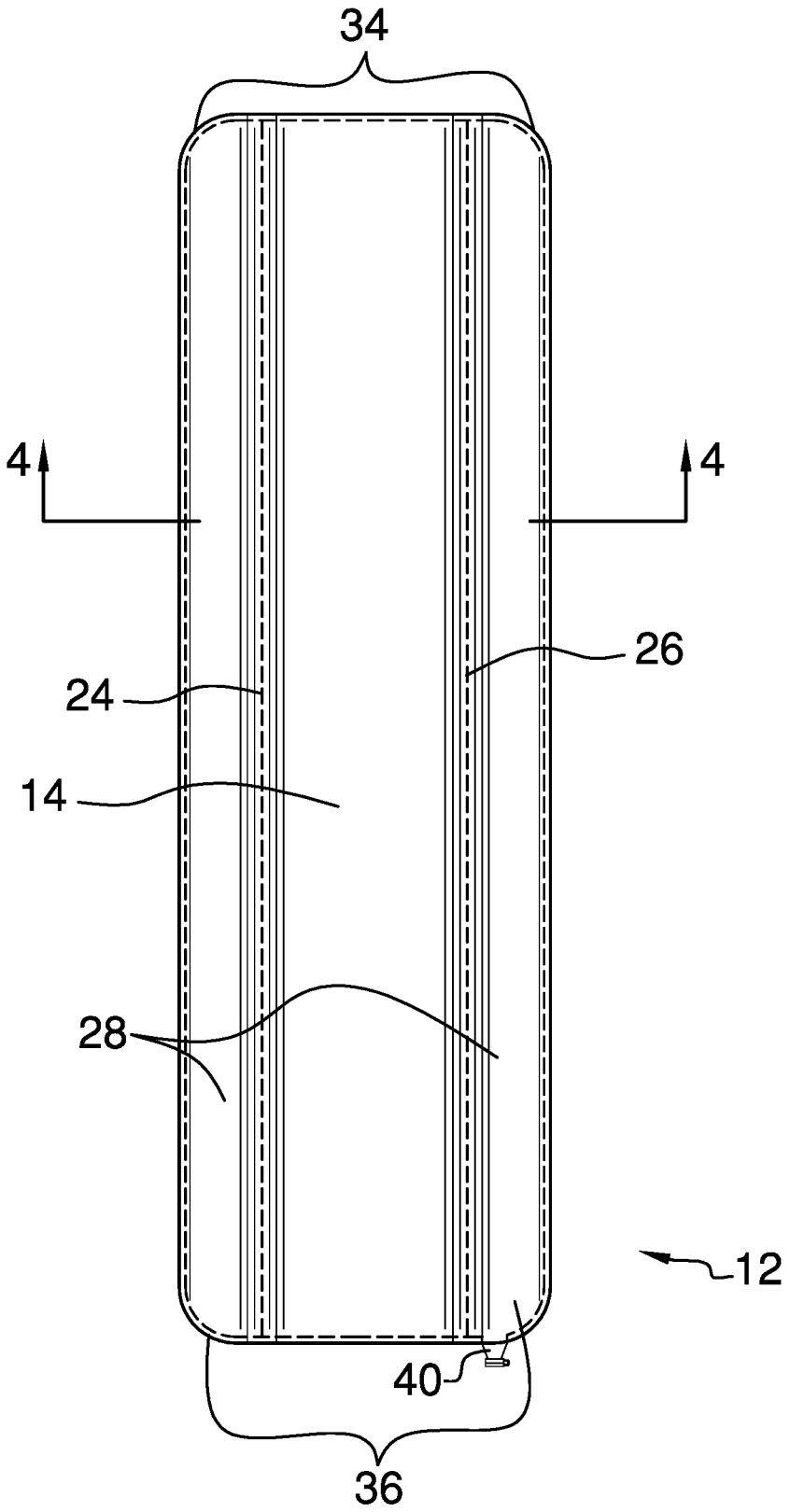
FIG. 3 is a bottom plan view of an embodiment of the disclosure.
Figure 4:
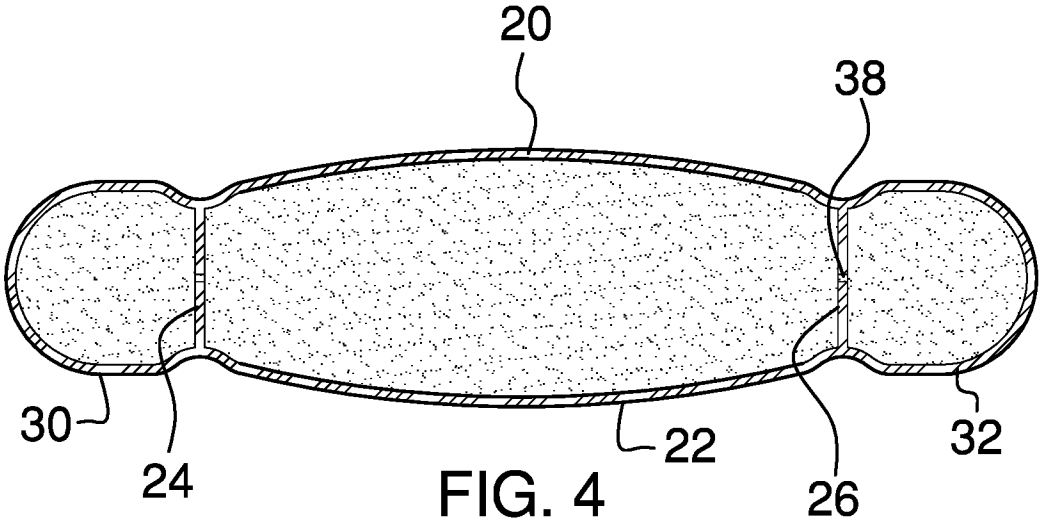
FIG. 4 is a cross-sectional view of an embodiment of the disclosure along line 4-4 of FIG. 3.
Figure 5:
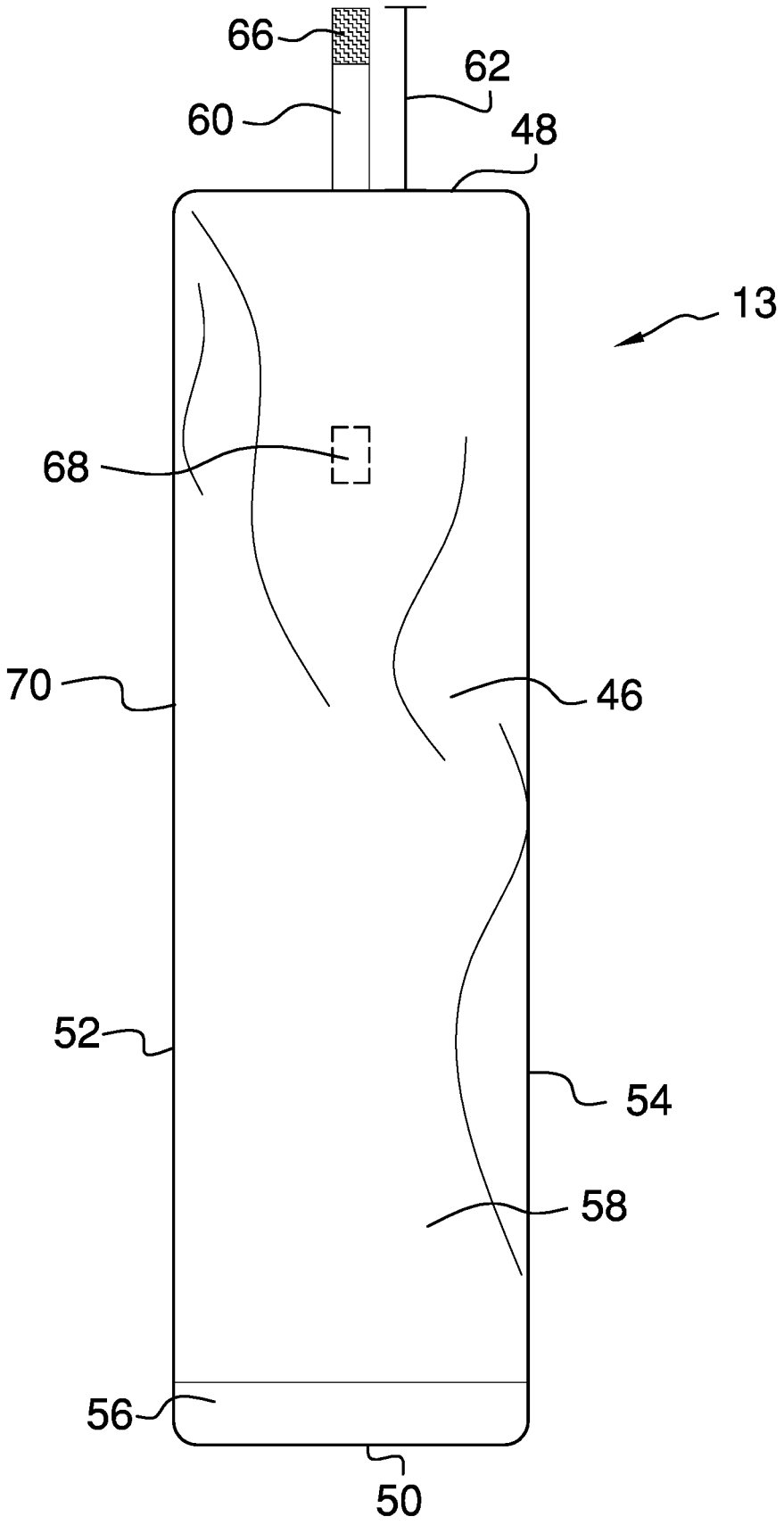
FIG. 5 is a detail view of an embodiment of the disclosure.
Figure 6:
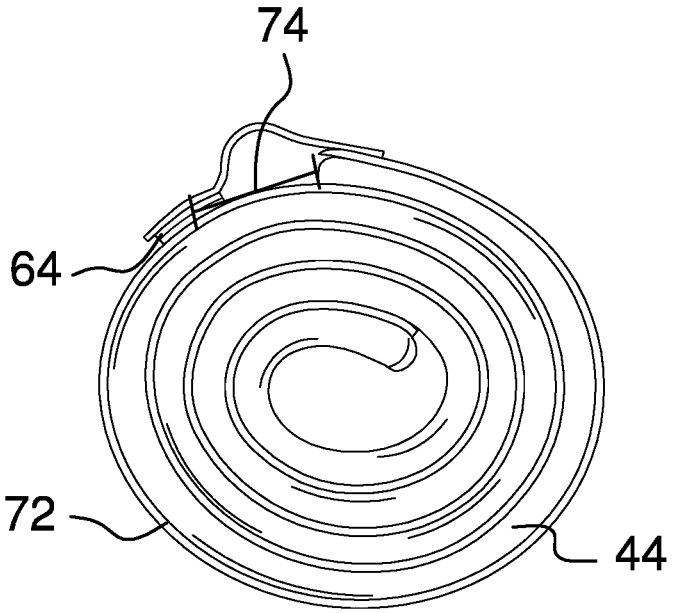
FIG. 6 is a detail view of an embodiment of the disclosure.

With reference now to the drawings, and in particular to FIGS. 1 through 6 thereof, a new body pillow embodying the principles and concepts of an embodiment of the disclosure and generally designated by the reference numeral 10 will be described.

As best illustrated in FIGS. 1 through 6, the inflatable body pillow and pillow case kit 10 generally comprises an inflatable body pillow 12 and a pillow case 13. The inflatable body pillow 12 comprises a principal chamber 14 having a top end 16, a bottom end 18, an upper side 20, a lower side 22, a left wall 24, and a right wall 26. The top end 16 and the bottom end 18 may be a truncated elliptical shape having the upper side 20 and the lower side 22 curved and the right wall 26 and the left wall 24 truncated flat. The curved upper side 20 and lower side 22 optimize comfort while the flat right wall 26 and left wall 24 optimize structural support. A pair of side chambers 28 is coupled to the principal chamber 14. The pair of side chambers 28 comprises a left chamber 30 and a right chamber 32 continuously coupled to the left wall 24 and the right wall 26, respectively. Each of the pair of side chambers 28 has a top corner 34 and a bottom corner 36. Each of the top corner 34 and the bottom corner 36 may be rounded. A plurality of vents 38 is coupled to the principal chamber 14. The plurality of vents 38 is disposed within each of the left wall 24 and the right wall 26 to allow air to flow between the principal chamber 14 and the pair of side chambers 28. A valve 40 is coupled through the bottom end 18 of the principal chamber and is configured to allow a user to inflate and alternatively deflate the principal chamber 14 and the pair of side chambers 28. The inflatable body pillow 12 thus has an inflated state 42 and an alternate deflated state 44, the inflatable body pillow 12 being rollable in the deflated state 44.

The pillow case 13 comprises a case body 46 having a top edge 48, a bottom edge 50, a left edge 52, a right edge 54, a top side 56, and a bottom side 58. The top side 56 is coupled to the bottom side 58 along the top edge 48, the left edge 52, and the right edge 54. The bottom edge 50 is open and receives the inflatable body pillow 12. A strap 60 may be coupled to the top edge 48 of the case body. The strap 60 has a strap length 62. A fastener 64 comprises a first element 66 coupled to the strap 60 and a second element 68 coupled to the bottom side 58 of the case body. The first element 66 is selectively engageable with the second element 68. The fastener 64 may be a hook-and-loop fastener. The inflatable body pillow and pillow case kit 10 has a flat position 70 and an alternate rolled position 72. The fastener 64 maintains the inflatable body pillow 12 and the pillow case 13 in the rolled position 72 when the first element 66 engages the second element 68. The fastener 64 is a fastener distance 74 from the top edge 48 when the inflatable body pillow 12 and the pillow case 13 are the rolled position 72. The strap length 62 may be greater than the fastener distance 74 to allow the strap 60 to function as a handle.

In use, the inflatable body pillow 12 is inflated using the valve 40 and used as a sleep aid within the pillow case 13. When done, the inflatable body pillow 12 is deflated and the inflatable body pillow and pillow case kit 10 is rolled into the rolled position 72 and the fastener 64 is engaged.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An inflatable body pillow and pillow case kit, the kit comprising:

an inflatable body pillow comprising:

a principal chamber having a top end, a bottom end, an upper side, a lower side, a left wall, and a right wall, the top end and the bottom end being a truncated elliptical shape having the upper side and the lower side curved and the right wall and the left wall truncated flat the principal chamber being elongated, straight and continuously open between the top end and the bottom end;

a pair of side chambers coupled to the principal chamber, the pair of side chambers comprising a left chamber and a right chamber continuously coupled to the left wall and the right wall, respectively, each of the pair of side chambers having a top corner and a bottom corner, each of the top corner and the bottom corner being rounded;

a plurality of vents coupled to the principal chamber, the plurality of vents being disposed within each of the left wall and the right wall to allow air to flow between the principal chamber and the pair of side chambers; and a valve coupled to the principal chamber, the valve being coupled through the bottom end and configured to allow a user to inflate and alternatively deflate the principal chamber and the pair of side chambers, the inflatable body pillow thus having an inflated state and an alternate deflated state, the inflatable body pillow being rollable in the deflated state; and a pillow case comprising:

a case body having a top edge, a bottom edge, a left edge, a right edge, a top side, and a bottom side, the top side being coupled to the bottom side along the top edge, the left edge, and the right edge, the bottom edge being open and receiving the inflatable body pillow;

a strap coupled to the case body, the strap being coupled to the top edge of the case body, the strap having a strap length; and a fastener coupled to the strap and the case body, the fastener comprising a first element being coupled to the strap and a second element being coupled to the bottom side of the case body, the first element being selectively engageable with the second element, the inflatable body pillow and pillow case kit having a flat position and an alternate rolled position, the fastener maintaining the inflatable body pillow and the pillow case in the rolled position when the first element engages the second element, the fastener being a fastener distance from the top edge when the inflatable body pillow and the pillow case are in the rolled position, the strap length being greater than the fastener distance allowing the strap to functioning as a handle.

2. An inflatable body pillow and pillow case kit, the kit comprising:

an inflatable body pillow comprising:

a principal chamber having a top end, a bottom end, an upper side, a lower side, a left wall, and a right wall, the top end and the bottom end each being truncated elliptical shaped having the top side and the lower side being curved and the left wall and the right wall being straight, the principal chamber being elongated, straight and continuously open between the top end and the bottom end;

a pair of side chambers coupled to the principal chamber, the pair of side chambers comprising a left chamber and a right chamber continuously coupled to the left wall and the right wall, respectively;

a plurality of vents coupled to the principal chamber, the plurality of vents being disposed within each of the left wall and the right wall to allow air to flow between the principal chamber and the pair of side chambers; and a valve coupled to the principal chamber, the valve being coupled through the bottom end and configured to allow a user to inflate and alternatively deflate the principal chamber and the pair of side chambers, the inflatable body pillow thus having an inflated state and an alternate deflated state; and a pillow case comprising:

a case body having a top edge, a bottom edge, a left edge, a right edge, a top side, and a bottom side, the top side being coupled to the bottom side along the top edge, the left edge, and the right edge, the bottom edge being open and receiving the inflatable body pillow.

3. The inflatable body pillow and pillow case kit of claim 2 further comprising a strap and a fastener, the strap being coupled to the top edge of the case body, the fastener comprising a first element being coupled to the strap and a second element being coupled to the bottom side of the case body, the first element being selectively engageable with the second element, the inflatable body pillow and pillow case kit having a flat position and an alternate rolled position, the inflatable body pillow being rollable in the deflated state, the fastener maintaining the inflatable body pillow and the pillow case in the rolled position when the first element engages the second element.

4. The inflatable body pillow and pillow case kit of claim 2 further comprising the fastener being a fastener distance from the top edge when the inflatable body pillow and the pillow case are in the rolled position, the strap having a strap length greater than the fastener distance, the strap thus functioning as a handle.

5. The inflatable body pillow and pillow case kit of claim 2 further comprising each of the pair of side chambers having a top corner and a bottom corner, each of the top corner and the bottom corner being rounded.

6. The inflatable body pillow and pillow case kit of claim 5 further comprising the fastener being a hook-and-loop fastener.

* * * * *